United States Patent [19]

Metro

[11] 4,417,408

[45] Nov. 29, 1983

[54] ADJUSTABLE MECHANICALLY CUSHIONED HEEL FOR A SHOE

[76] Inventor: Robert D. Metro, 848 Roxbury La., Noblesville, Ind. 46060

[21] Appl. No.: 313,454

[22] Filed: Oct. 21, 1981

[51] Int. Cl.[3] ..... A43B 21/36; A43B 21/47

[52] U.S. Cl. ..... 36/36 R; 36/38

[58] Field of Search ..... 36/36 R, 36 A, 35, 38, 36/40, 42, 15, 103, 114, 129, 71.5, 73

[56] References Cited

U.S. PATENT DOCUMENTS

| | | | |
|---|---|---|---|
| 357,062 | 2/1887 | Buch | 36/38 |
| 1,625,048 | 4/1927 | Nock | 36/38 |
| 2,447,603 | 8/1948 | Snyder | 36/38 |
| 2,508,318 | 5/1950 | Wallach | 36/38 |
| 2,548,308 | 4/1951 | Hensley | 36/38 |
| 3,822,488 | 7/1974 | Johnson | 36/129 |
| 3,886,674 | 6/1975 | Pavia | 36/38 |
| 4,246,706 | 1/1981 | Persons, Jr. | 36/71.5 X |

FOREIGN PATENT DOCUMENTS

| | | | |
|---|---|---|---|
| 7583 | of 1890 | United Kingdom | 36/42 |

*Primary Examiner*—James Kee Chi

*Attorney, Agent, or Firm*—Barnes & Thornburg

[57] ABSTRACT

An adjustable mechanically cushioned heel for a shoe comprises a heel insert attached to the heel area of the shoe and a ground-engaging member removably attached to the insert. The ground-engaging member includes a relatively stiff spring element to provide a cushioning effect in the heel area. An adjustable coupling between the ground-engaging member and the insert allows the user to alter the spring constant of the spring element to vary the cushioning effect of the heel.

7 Claims, 4 Drawing Figures

ADJUSTABLE MECHANICALLY CUSHIONED HEEL FOR A SHOE

This invention relates to shoe heels, and more particularly to a replaceable heel for an athletic shoe, including mechanical means for adjustably cushioning the heel.

It is common practice in the shoe industry to provide athletic shoes with integrated soles and heels. See for example, U.S. Pat. No. 4,279,083. Whenever the heel or sole wears out, the entire shoe or at least the entire sole and heel must be replaced. In many athletic shoes, and in particular running shoes, the heel area is constantly subjected to strong pressure influences causing such area to wear very rapidly relative to other areas of the shoe. Thus, owners of running shoes are often required to purchase new shoes when in fact all that is needed is a new heel area.

Because of the constant pressure influence on the heel area of a running shoe, such area is typically cushioned. The cushioning effect has heretofore been achieved by a relatively thick layer of foam material on the heel area. As the heel area begins to wear, the cushioning effect becomes less until insufficient cushioning remains. Conventional running shoes do not include any way for increasing the cushioning effect due to wear. One proposed solution has been to provide foam material for addition to the heel area as it begins to wear. However, in most instances, new running shoes are purchased not because the heel area is completely worn through, but because the heel are provides insufficient cushioning.

Another disadvantage of most running shoes is that the heel area provides a predetermined amount of cushioning when the shoe is new. This may not represent a significant problem if the amount of cushioning needed by the runner is less than the predetermined amount. However, if the runner needs more cushioning, there is no way to increase the cushioning effect.

Replaceable heels for shoes have been used before. For example, U.S. Pat. No. 1,773,242 discloses a shoe with an interchangeable sole and heel. U.S. Pat. Nos. 2,802,285 and 3,271,885 also disclose replaceable heels for shoes. U.S. Pat. No. 3,742,622 is of interest because it shows a foam filled heel for an athletic shoe. However, none of these patents allow the cushioning effect of the heel area to be adjusted to compensate for individual height and weight and for wear of the heel area.

As disclosed in the above patents, even in shoes with replaceable heels, it has been the practice to provide cushioning for the heel area by using impact-absorbing material such as rubber. Applicant, on the other hand, provides mechanical means for adjustably cushioning the heel area of a shoe.

One advantage obtained by the use of mechanical means such as a spring for cushioning is that the spring constant can be altered to adjust the cushioning effect. Another advantage is that the amount of cushioning which the heel provides is not dependent on the material composition of the heel. The spring and the surface-engaging area of the heel can be made of two different materials so that the most desired combination of cushion and long wear can be incorporated into the heel through the proper selection of materials for the spring and the surface-engaging area.

It is therefore an object of the present invention to provide a heel for a shoe which can be adjusted to provide a variable cushioning effect.

Another object of this invention is to provide a heel for a shoe which is replaceable by the user of the shoe.

It is a further object of this invention to provide a shoe in which the cushioning effect thereof is produced by mechanical means such as a spring so that as the heel area becomes worn the spring constant can be altered to prolong the cushioning effect of the heel area.

According to the present invention, a replaceable shoe heel includes a mechanical spring for cushioning the heel area and means for adjusting the cushioning effect thereof.

Other objects and advantages of the present invention will become apparent to those skilled in the relevant art upon consideration of the accompanying drawings illustrating the invention and showing a preferred embodiment exemplifying the best mode of carrying out the invention as presently perceived.

Figure 1:
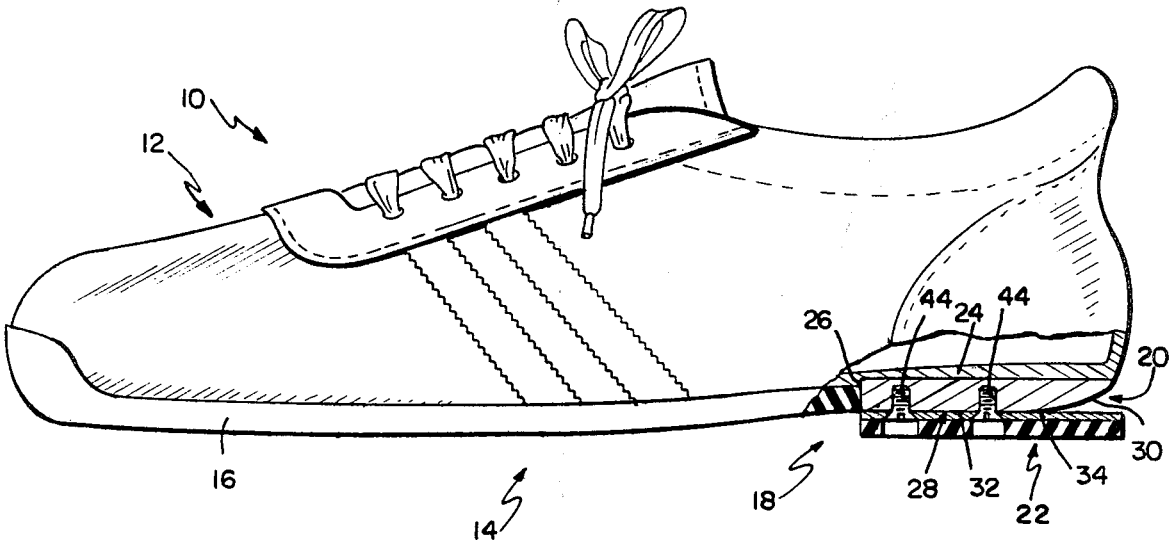
FIG. 1 is a side elevational view, partly broken away and cross-sectioned, or an athletic shoe embodying a heel constructed according to the present invention.

Referring now to FIG. 1, a shoe 10 includes an upper portion 12 and a lower portion 14. The lower portion 14 includes a sole 16 and a heel 18 embodying the present invention. The heel 18 includes a permanent heel insert 20 attached to the upper portion 12 of the shoe 10 and a replaceable ground-engaging cushioning means 22. The heel insert 20 includes an upper surface 24, a front surface 26, and a lower surface 28. The upper and front surfaces 24 and 26 fit into a recess provided in the upper portion 12 of the shoe 10 and are attached thereto by conventional means, such as glue, tacks, nails, etc. Both the upper surface 24 and the front surface 26 are relatively planar. On the other hand, the lower surface 28 includes a curved section 30 providing a lower arcuate surface and a planar section 32. As shown in FIG. 1, the sections 30 and 32 intersect or blend at a point 34. It can be appreciated that the heel insert member 20 will have generally the same shape as the rear of the upper portion 12 of the shoe 10 so that sides of the heel insert 20 will generally conform to the contour of the rear of the upper portion 12. In some instances, the heel insert 20 may have sides which flare outwardly to provide a wider base for the ground-engaging member 22. In the preferred embodiment, the heel insert 20 is fabricated from a lightweight rigid material, such as plastic or aluminum, in order to minimize the weight of the shoe. However, other materials can be used to construct the heel insert 20 without departing from the scope of the invention.

Figure 2:
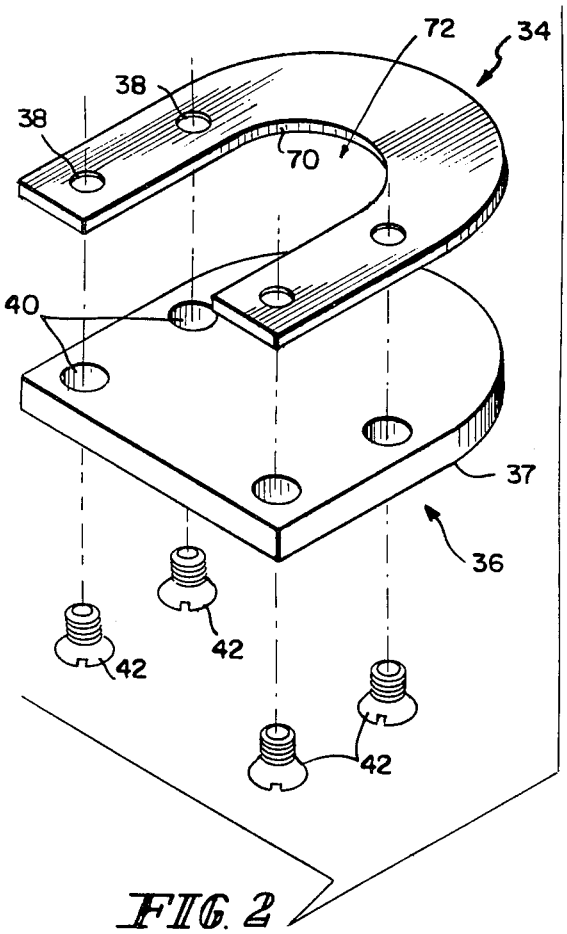
FIG. 2 is an exploded perspective view of a portion of the heel structure shown in FIG. 1.

Referring to FIG. 2, the cushioning means 22 of the heel 18 includes a generally U-shaped flexible member 34 and a generally D-shaped ground-engaging heel sole 36. In the preferred embodiment, the flexible member 34 is made of relatively stiff spring steel having sufficient flexibility to provide a cushioning effect in the heel area of the shoe 10 when flexed at a fulcrum point 34. In the preferred embodiment, the ground-engaging heel sole 36 is made of a soft cushioning material such as rubber which provides an additional cushioning effect between the flexible member 34 and the ground and provides traction between the ground surface and the heel 18. If so desired, the lower surface 37 of the heel sole 36 can include ridges, cleats, or other surface configurations normally used to aid traction. It should be noted that both the flexible member 34 and the heel sole 36 are relatively thin so as not to add an appreciable thickness to the heel area of the shoe 10.

The flexible member 34 includes apertures 38 which align with apertures 40 provided in the heel sole 36. The flexible member 34 and heel sole 36 are secured together by conventional means, such as glue or other adhesive materials, to form a replaceable heel cushioning unit 22 which in turn is removably attached to the heel insert 20. The heel cushioning unit 22 is attached to the heel insert 20 by screws 42. Screws 42 are threadably received in threaded slots 44 formed in the heel insert 20, as shown in FIG. 1. As best seen in FIG. 1, the heads of the screws 42 are recessed in the heel sole 36 so that they do not engage the ground surface.

Figure 3:
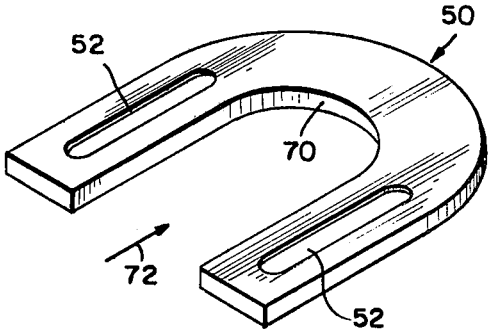
FIG. 3 is a perspective view of another embodiment of one of the two sections of the heel portion shown in FIG. 2.

Referring now to FIG. 3, another embodiment of a flexible member 50 is shown. Flexible member 50 is also made of relatively stiff spring steel. Flexible member 50 includes slots 52 in place of discrete apertures 38. It can be appreciated that if the flexible member 50 includes elongated slots 52, then the heel sole 36 will also include corresponding elongated slots. The use of slots instead of apertures achieves the advantage of enabling the user to adjust the cushioning means 22 forward and rearward on the heel insert 20. This forward and rearward adjustment alters the spring constant of the flexible member 50 by changing the amount of the member 50 extending rearwardly from point 34 under the arcuate surface 30 of the heel insert 20. Therefore, the cushioning effect of the spring-loaded cushioning unit 22 can be adjusted for individual size, weight, and personal preference, and to maintain a generally constant cushioning effect during prolonged use of the shoe 10. By moving the cushioning unit 22 rearward, the spring constant of the flexible member 50 becomes less and therefore more flexible, thereby reducing the cushioning effect. By moving the unit 22 forward, the spring constant of the flexible member 50 is increased, and is therefore less flexible, thereby increasing the cushioning effect. When the ground-engaging heel sole 36 wears out, the unit 22 can be removed from the heel insert 20 and a new cushioning unit 22 secured to the insert 20.

Figure 4:
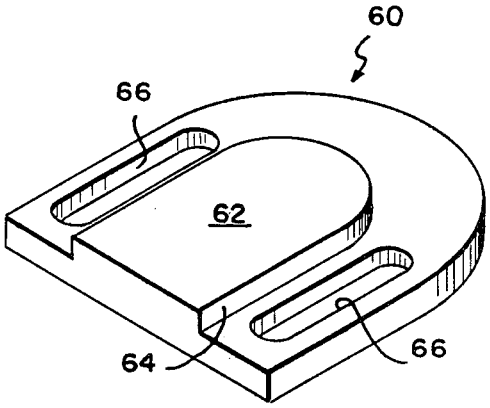
FIG. 4 is a perspective view of another embodiment of the other of the two sections of the heel portion shown in FIG. 2.

Referring now to FIG. 4, an alternate embodiment of a heel sole 60 is shown. Heel sole 60 includes a D-shaped ridge 62 having an outer edge 64. When the heel sole 60 is secured to either the flexible member 34 or 50, the outer edge 64 is contiguous with the inner surface 70 of the flexible member (34 or 50). Preferably, the ridge 62 is of approximately the same thickness as the flexible member (34 or 50). The ridge 62 is useful in aligning the heel sole 60 relative to the flexible member 34 or 50. The ridge 62 also serves to fill the open area 72 provided in the generally U-shaped flexible member 34 or 50. The heel sole 60 may include apertures or slots 66 depending upon the flexible member 34 or 50, respectively, and is secured to the flexible member 34 or 50 by conventional means, such as glue or other adhesive material.

While the embodiment described above is presently the best perceived mode of carrying out the invention, other mechanical means for providing cushioning of the heel area of a shoe and for adjusting the cushioning effect thereof may be employed without departing from the scope of the present invention.

What is claimed is:

1. In a shoe including an upper portion and a lower portion having a sole and a heel area and spring-loaded means for cushioning the heel area, the improvement wherein the heel area includes a generally planar lower surface and arcuate lower surface extending rearwardly and upwardly therefrom, the spring-loaded means includes a flexible cushioning member extending rearwardly generally parallel to the planar lower surface of the heel area, the planar and arcuate surfaces of the heel area providing a fulcrum for flexion of a rearward portion of the cushioning member to produce a cushioning effect, and adjustment means for varying the cushioning effect of the spring-loaded means, the adjustment means including at least one elongated slot in the cushioning member and means received in the slot for securing the cushioning member to the heel area, the slot allowing the cushioning member to be moved forwardly and rearwardly relative to the fulcrum to change the spring constant of the rearward portion thereof.

2. The improvement of claim 1 wherein the heel area includes a heel insert providing the planar and arcuate lower surfaces and means for securing the heel insert to the heel area of the shoe.

3. The improvement of claim 2 wherein the cushioning member includes a relatively stiff spring steel plate, a layer of cushioning material, and means for securing the layer of cushioning material to the plate.

4. The improvement of claim 3 wherein the spring steel plate is genrally U-shaped and the layer of cushioning material includes a ridge for engaging the inner surface of the U-shaped plate.

5. In a shoe including an upper portion and a lower portion having a sole and a heel area, the improvement comprising an adjustable mechanically cushioned heel, the heel including an insert providing a fulcrum, means for attaching the insert to the heel area, a ground-engaging member, and means for coupling the ground-engaging member to the insert so that a portion thereof extends beyond the fulcrum, the ground-engaging member including a flexible spring element providing a cushioning effect, the coupling means including means for altering the spring constant of the spring element to vary the cushioning effect, the means for altering the spring constant including at least one elongated slot in the ground-engaging member to allow movement thereof with respect to the fulcrum, and means received in the slot for securing the ground-engaging member to the insert.

6. The improvement of claim 5 wherein the insert includes a lower surface having a planar region, an arcuate region extending rearwardly, and a flexion point joining the planar and arcuate regions, the spring element is generally planar and extends rearwardly generally parallel to the planar region of the insert, the flexion point joining the planar and arcuate regions serving as the fulcrum for flexion of the spring element.

7. In a shoe including an upper portion and a lower portion having a sole and a heel area, the improvement comprising a generally planar spring element for cushioning the heel area, the heel area including means providing a fulcrum for flexion of the spring element, means for coupling the spring element to the heel area so that a portion of the spring element extends beyond the fulcrum to cushion the heel area, and adjustment means for varying the length of the portion of the spring element which extends beyond the fulcrum to alter the spring constant and vary the cushioning effect thereof.

* * * * *